United States Patent [19]

Ford, Jr.

[11] Patent Number: 4,636,015

[45] Date of Patent: Jan. 13, 1987

[54] RF CONNECTOR

[75] Inventor: Alexander P. Ford, Jr., Boca Raton, Fla.

[73] Assignee: Motorola, Inc., Schaumburg, Ill.

[21] Appl. No.: 771,098

[22] Filed: Aug. 30, 1985

[51] Int. Cl.[4] ..... H01R 17/04

[52] U.S. Cl. ..... 339/14 R; 339/17 E; 339/177 E

[58] Field of Search ..... 339/177 R, 177 E, 17 F, 339/176 MF, 17 E, 14 R, 255 R

[56] References Cited

U.S. PATENT DOCUMENTS

| | | | |
|---|---|---|---|
| 3,179,914 | 4/1965 | Uberbacher | 339/177 R |
| 3,201,722 | 8/1965 | May et al. | 339/177 R |
| 3,425,025 | 1/1969 | Williams | 339/75 M |
| 3,917,372 | 11/1975 | Selinko | 339/75 M |
| 3,946,390 | 3/1976 | Alexander et al. | 343/702 |
| 3,969,728 | 7/1976 | Hodsdon et al. | 343/702 |
| 4,024,542 | 5/1977 | Ikawa et al. | 343/702 |
| 4,339,756 | 7/1982 | Oyama et al. | 343/702 |
| 4,417,776 | 11/1983 | Motoyama | 339/255 R |
| 4,540,227 | 9/1985 | Faraci | 339/17 F |

OTHER PUBLICATIONS

AMP Incorporated Data Sheet No. 74-256, Revised 5-77, AMP Ampliflex Connector.

*Primary Examiner*—John McQuade

*Attorney, Agent, or Firm*—Daniel K. Nichols; Joseph T. Downey; Donald B. Southard

[57] ABSTRACT

This RF connector includes a strip line for providing a proper impedance match to coaxial cable. At one end of the strip line, pins are attached to a center conductor and to the ground plane to mate with flush coaxial contacts. In a modified version, the ground connection is provided by a flexible member that is attached to the strip line and has a ground contact projecting therefrom. The flexible member provides biasing force on the ground contact. A resilient pad engages the strip line to urge the contacts into engagement.

9 Claims, 14 Drawing Figures

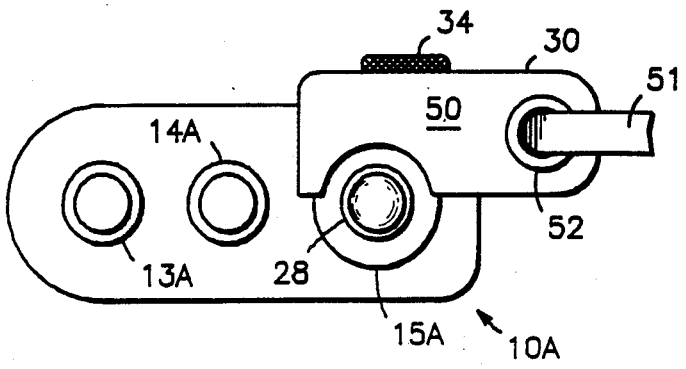
FIG. 2
FIG. 3
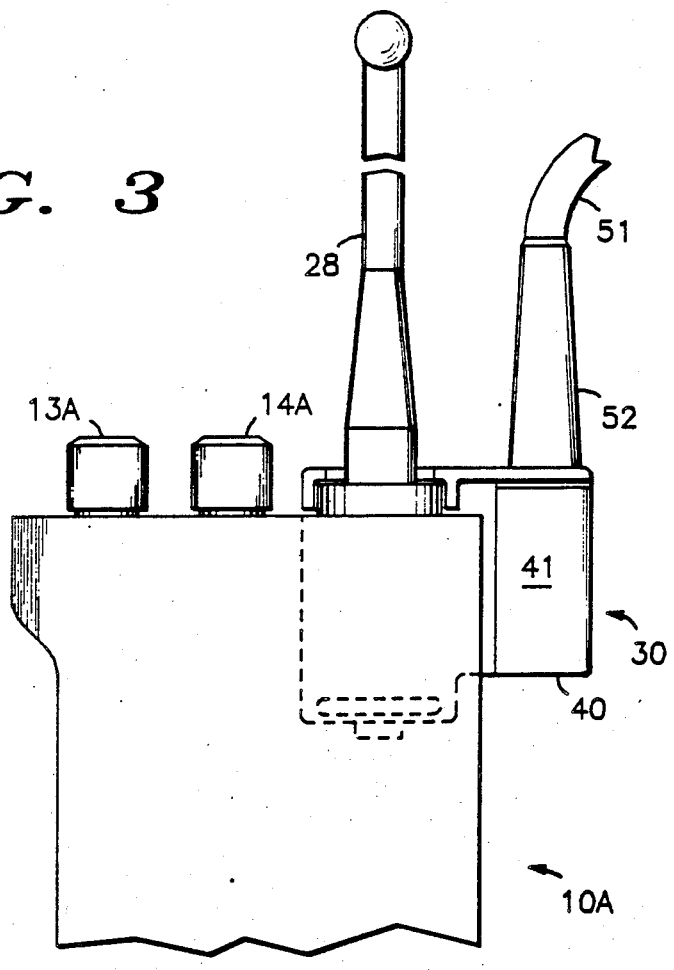

FIG. 6
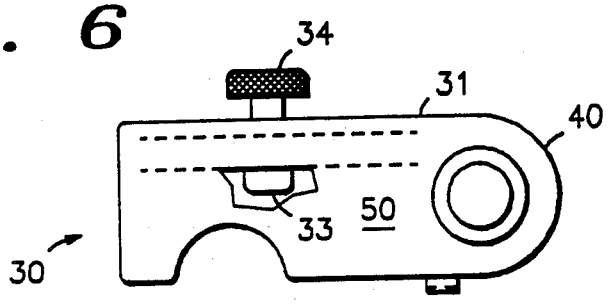
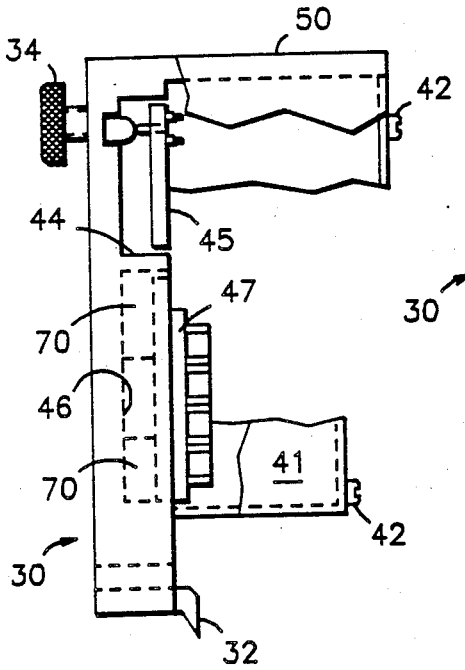
FIG. 5
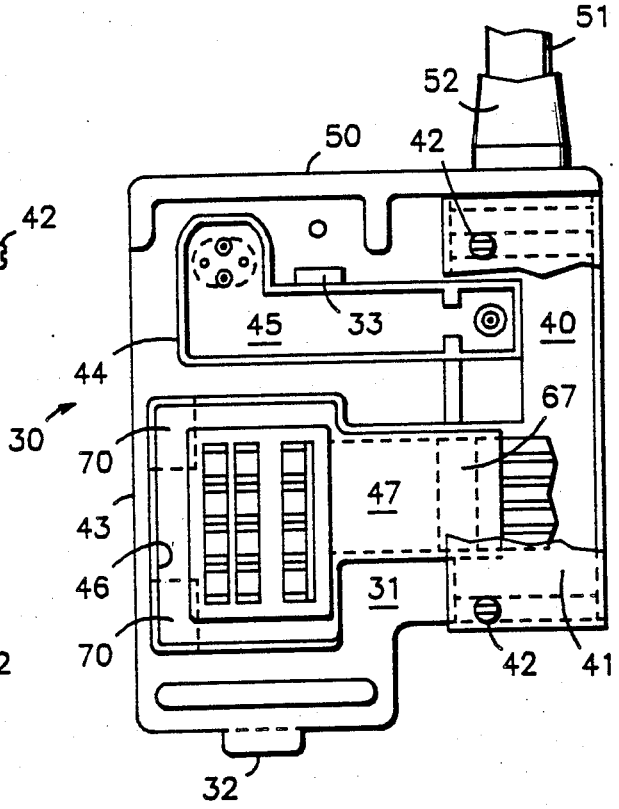
FIG. 4

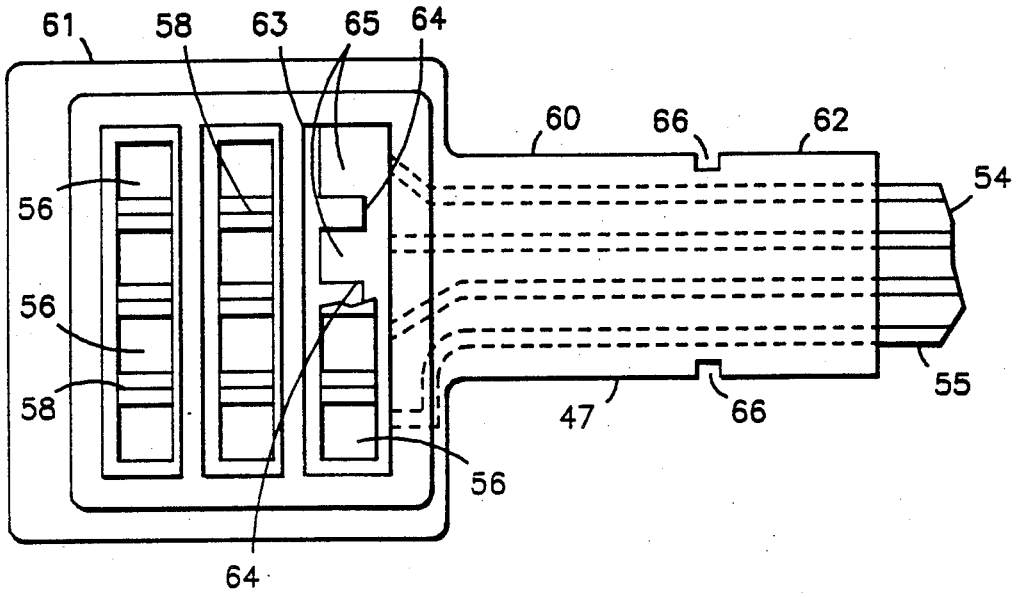
FIG. 7
FIG. 8
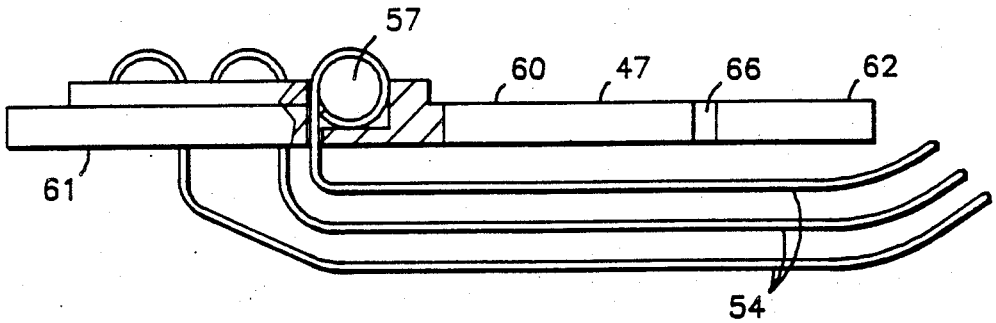

RF CONNECTOR

BACKGROUND OF THE INVENTION

This invention relates to electrical connectors in general and in particular to RF connectors for connection with flush coaxial contacts. The use of flush RF contacts provides a clean surface which can be sealed to inhibit the intrusion of foreign materials such as moisture and dust. Such flush contacts can also conserve space as they occupy little volume, unlike connectors that have substantial portions within a housing or which project from the housing.

In RF connectors, it is important that the connector have a proper impedance to match the line to which it is connected. This becomes particularily significant when dealing with VHF and UHF frequencies, for very slight variations in connection dimensions and position can greatly effect its impedance.

SUMMARY OF THE INVENTION

This RF connector includes contacts for mating with flush coaxial contacts. A connector housing carries a strip line that includes opposed ground planes on its surfaces. A conductor runs between the ground planes and is insulated therefrom. The strip line has an overall configuration which is longitudinal with opposed ends and is mounted to the housing substantially at one of the ends. Contact means are located adjacent to the other end of the strip line and include a center contact electrically connected to the conductor and a ground plane contact electrically connected to the ground planes for engaging flush coaxial contacts.

In one aspect of the invention, biasing means operatively engage the strip line for biasing the center and ground plane contacts into contact with the coaxial contacts. In another aspect of the invention, the biasing means include a resilient pad operatively engageable with the strip line.

In still another aspect of the invention, the pad operatively engages the strip line between the ground and center contacts. A cylindrical member is positioned on the opposite side of the strip line from the center and ground contacts and the resilient pad engages the cylindrical member. This cylindrical member is located substantially half way between the center and ground contacts and has an axis which is oriented transversely of a line between said center and ground contacts.

In another preferred embodiment of the invention, the ground plane contact includes a flexible conductive member attached to the strip line and a ground contact surface projecting therefrom.

In one aspect of the invention, the flexible contact member is riveted to the strip line. In another aspect of the invention, the ground contact projects beyond the center contact for providing first contact with the coaxial contacts and the flexible contact member bends to position the ground contact in the plane of the center contact for providing electrical connection to both the coaxial contacts. In still another aspect of the invention, the ground contact defines an arcuate surface.

Applicants copending application entitled "Accessory Connector," filed on even date herewith, which relates to multi-contact connectors is hereby incorporated by reference.

BRIEF DESCRIPTION OF THE DRAWINGS

FIG. 2 is a top plan view of a radio with a connector attached.

FIG. 3 is a fragmentary elevation view of the radio of FIG. 2.

FIG. 4 is an elevational view of a connector partially cut away.

FIG. 5 is a side elevational view of the connector of FIG. 4.

FIG. 6 is an top plan view of the connector of FIG. 4.

FIG. 7 is an enlarged fragmentary of the flex contact assembly of FIG. 4.

FIG. 8 is a side elevational view partially cut away of the flex contact assembly of FIG. 7.

DESCRIPTION OF THE PREFERRED EMBODIMENT

Figure 1:
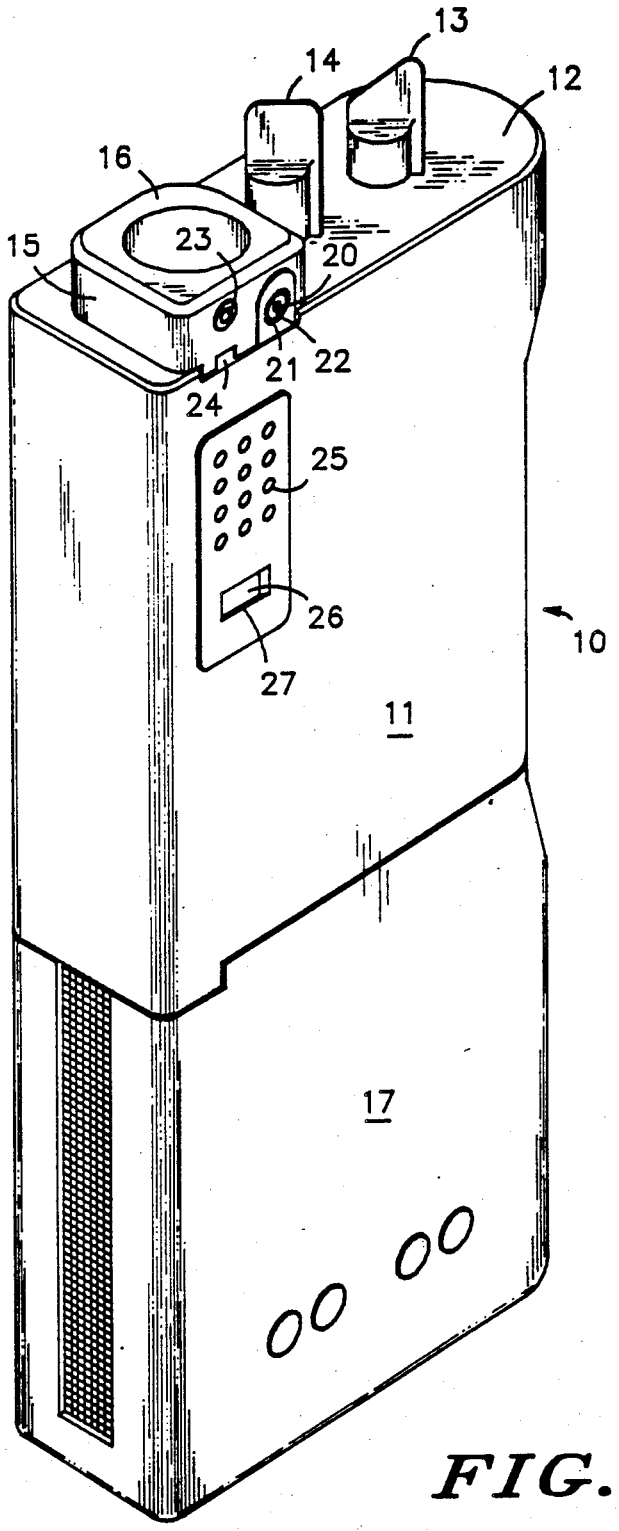
FIG. 1 is a perspective view of a portable radio having flush accessory and RF contacts.

Referring now by characters of reference to the drawings, and first to FIG. 1, it will be understood that a portable radio indicated generally as 10 can utilize the connector of this invention. The radio 10 includes a body 11 to which a battery portion 17 is detachably connected.

The body 11 includes a top 12 which carries volume and channel control knobs 13 and 14. The top 12 includes a pedestal portion 15 which can include a threaded mount 16 that is provided for receiving an antenna (not shown). The rear surface of the pedestal 15 includes flush coaxial RF contacts, including a center conductor 20 with a concentric connector portion 21 and insulator portion 22 between the center and concentric portions. The pedestal 15 also contains a threaded insert 23 provided for connector fastening purposes. The radio body 11 with pedestal 15 further defines a recess 24.

A plurality of electrical contacts 25 which, in this case, constitute 12 contacts laid out in grid fashion, are located on the back of the radio housing 11. It will be understood that the contacts 25 are substantially flush with the back of radio housing 11 and that the contacts 25 as well as contacts 20 and 22 lie substantially in the same plane as the back of the radio 10. Positioned below the contacts 25 in the radio body 11 is a tapered recess 26 having a lower lip 27. It will be appreciated that the contacts 25 are substantially positioned between the tapered recess 26 and threaded insert 23.

In FIGS. 2 and 3 a slightly modified radio 10A is shown with a connector 30 attached thereto. An antenna 28 is shown mounted at the pedistal 15A. The connector 30 will be discussed in further detail in reference to FIGS. 4–11.

Referring first to FIG. 4, it will be seen that the connector 30 includes a housing 31 having a tab 32, more clearly shown in FIG. 3, as well as an upper alignment tongue 33. A threaded thumb screw 34, best seen in FIG. 3 and 4, is provided. It will be understood that when attaching the connector 30 to the radio 10, the tab 32 is first inserted in the recess 26 under the lip 27. The connector 30 is then pushed against the back of the radio 10 with the tongue 33 entering the slot 24 and the connector is fastened by threading the thumb screw 34 into the threaded insert 23 in order to mechanically mount the connector.

The connector housing 31 includes a body side portion 40 having a cover 41 which, when attached to the radio 10, are located to the side of the radio. The cover 41, is attached to the connector housing 30 as by screws 42.

The housing 31 includes a contact carrying portion 43 attached to the body side portion 40. The contact carrying portion 43 includes a first recess 44 which is contoured to receive an RF contact assembly 45 and a second recess 46 which is contoured to receive a multi-contact assembly 47.

The housing 31 includes a top portion 50 which both covers the body side portion 40 and extends over the contact carrying portion 43. Entering the body side portion 40 as through the top portion 50 is a cable 51 which is supported by flex-relief rubber member 52. It will be appreciated that electrical connections between the cable 51 and the assemblies 45 and 47 can be made within the body side portion 40.

The multi-contact assembly 47 is shown in greater detail in FIGS. 7 and 8. The particular assembly 47, of the preferred embodiment, utilizes three flex circuits 54 with each of the flex circuits having a plurality of electrically conductive circuit traces 55. The flex circuits 54 are formed from a base of polyimide material having a copper coating. The copper is etched to provide the desired circuit traces 55. After etching, the copper traces are coated first with nickel and then with gold to provide the final surface. At one end of the flex circuit 54, the traces 55 diverge and are widened to provide the individual contacts 56. Shear cuts 58 are provided between the contacts 56 in order to allow individual contact movement. This portion of the flex circuit is then wrapped around a cylindrical resiliently flexible material 57 such as silicon rubber and the flex circuit is adhered to itself as by pressure sensitive adhesive.

The assembly 47 includes a support member 60 having a contact carrying end portion 61 and a longitudinal portion 62 extending therefrom. The contact carrying portion 61 includes a plurality of slots 63 with one of the flex circuits 54 passing through a slot 63 with the contacts 56 disposed on one side of the contact carrying portion 61 and the flex circuit 54 extending on the other side of the contact carrying portion 61 and along the longitudinal portion 62. Contiguous with slot 63 is a plurality of notches 64 which define support fingers 65 in the contact carrying portion 61. Each of the support fingers 65 is positioned under one of the contacts 56 in order to provide individual support to that contact.

The longitudinal portion 62 includes a pair of opposed side notches 66 which receive the cover portion 41, as illustrated in FIG. 4, for locking the assembly 47 in position. A resilient pad of flexible silicon rubber material 67 is positioned under the assembly 47 in the area of the notches 66 as illustrated in FIG. 4. Resilient silicon rubber pads 70 are positioned in the contoured area 46 to engage the contact carrying portion 61.

Figure 9:
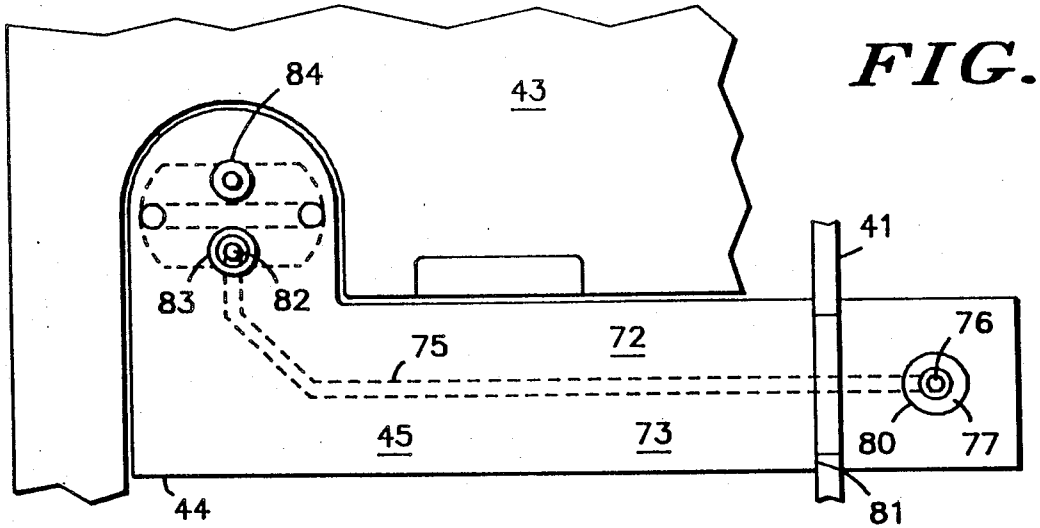
FIG. 9 is an enlarged view of the RF connector of FIG. 4.
Figure 10:
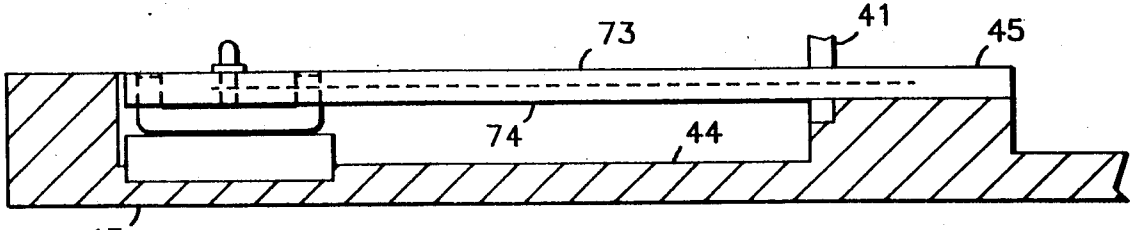
FIG. 10 is a side elevational view of the RF connector of FIG. 9.
Figure 11:
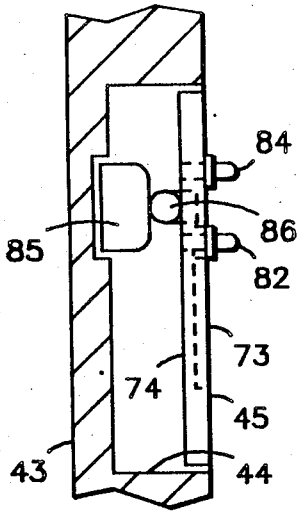
FIG. 11 is a side elevational view of the RF connector of FIG. 9.

Referring now to FIGS. 9–11, the RF assembly 45 and associated housing is shown in greater detail. The assembly 45 is provided by strip line 72 of longitudinal configuration having upper and lower opposed ground plain surfaces 73 and 74. Positioned between the surfaces 73 and 74 and electrically insulated from them is a conductor or conductive strip 75. At one end of the assembly 45, the strip 75 terminates at a plated-through hole 76 that is surrounded on the surface 73 by conductive pad 77 and an insulated, etched ring 80. Conductive pad 77 and hole 76 provide a connection point as for a center conductor of a coaxial cable while a shield of a connective sealed cable can be connected directly to the ground plane 72. Spaced from this end of the assembly 45 are a pair of opposed side notches 81 which can receive the cover 41 for locking the assembly 45 in position.

The opposite end of the conductive strip 75 is connected by a plated-through hole to a contact pin 82 which projects above ground plane surface 73 and is insulated therefrom by a etched area 83. A ground contact pin 84 is connected to the ground planes 73 and 74 in space relation from the pin 82 and also projects above the ground plane surface 73, the pins 82 and 84 providing contact means.

In order to bias the pins 82 and 84 into contact with a desired connector, a resilient silicon rubber pad 85 constituting biasing means is positioned below the ground plane surface 74 in an area approximately between pins 82 and 84. In order to provide uniform force at pins 82 and 84, the pad engages a cylindrical wire portion 86 that runs transversely from the line between pins 82 and 84 and at equal distance from the two pins. This cylindrical wire 86 is connected to the strip line 72 as by soldering to opposed end plated-through holes in the strip line 72.

Figure 12:
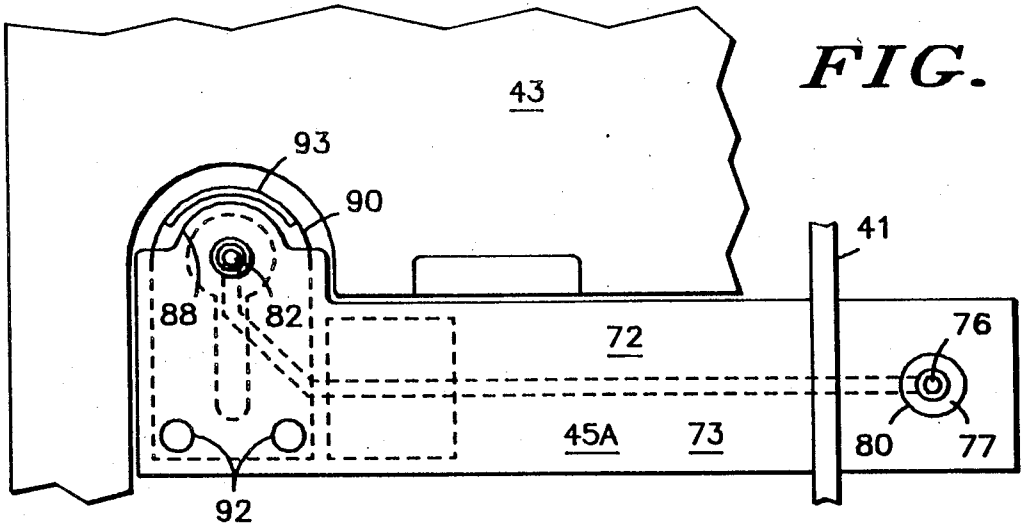
FIG. 12 is a view showing an alternative embodiment of the RF connector.
Figure 13:
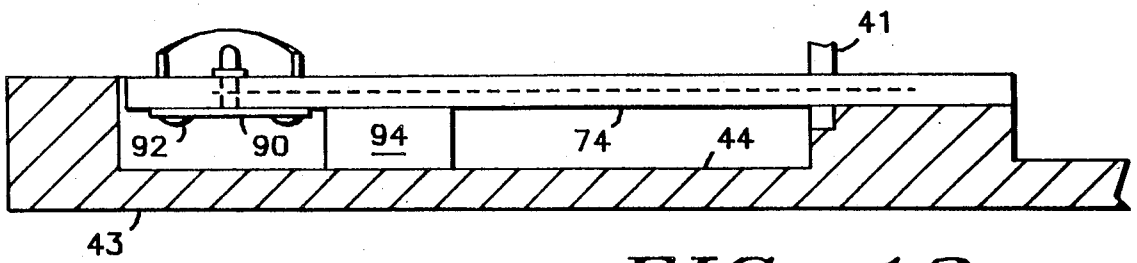
FIG. 13 is a side elevational view of the RF connector of FIG. 12.
Figure 14:
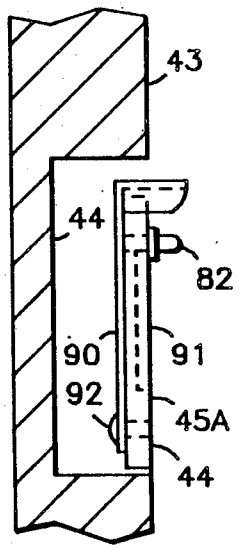
FIG. 14 is a side elevational view of the RF connector of FIG. 12.

An alternative preferred embodiment of the RF assembly 45 is disclosed in FIGS. 12–14, in which a different arrangement for connecting the ground is used to provide additional biasing capability and variation.

In this case, rather than using a ground pin 84, a flexible conductor member 90 which connects to the lower side 74 of the strip line 45A is used. The member 90 includes a spring-like portion 91 that is attached as by rivets 92 to the strip line 72A. The strip line 72A is configured with an arcuate edge 88 about the pin 82. The member 90 includes an upper outwardly extending arcuate ground contact 93 that projects above the surface of the ground plane 73. A resilient rubber pad 94 is placed adjacent to the member 90 between the ends of the strip line 72A.

It is thought that the structural features and functional advantages of the accessory connector have become fully apparent from the foregoing description of parts, but for completeness of disclosure a brief description of the operation and function of the connector will be given.

The strip lines 45 and 45A are constructed to provide the desired impedance for impedance-matching purposes. When the connector 30 is attached to a device, such as radio 10, the contacts 82 and 84 mate with the contacts 20 and 21. The resilient pad 85 engages the cylindrical wire 86 to bias the pins 82 and 84 firmly against the contacts 20 and 21. Any flexing of the strip line 45 will also place a biasing load on the pins 82 and 84. This arrangement therefore provides a reliable electrical interconnection of these contacts.

As for the strip line 45A, when the connector 30 is attached to a radio such as 10, the arcuate contact 93 engages the contact 21 and the portion 91 flexes to allow the end 93 to be pushed back so that it terminates in substantially the same plane as the end of the pin 82 which can then engage the contact 20. Because the portion 91 flexes more readily than the strip line 45, both contacts 82 and 93 will engage the connector. This allows for a greater degree of variation in the surface plane of the contacts 20 and 21.

While the connector 30 is shown as containing a plurality of contacts 56, it will be understood that these contacts or other contacts need not been included in the connector when only RF contacts are desired. Hence the connector 30 can be used with only the contacts of strip line 45 or 45A.

I claim as my invention:

1. A connector for mating with flush coaxial contacts comprising, a connector housing, a strip line including opposed ground planes and a conductor running between the ground planes and insulated therefrom, the strip line being of longitudinal configuration with opposed ends and mounted to the housing substantially at one of said ends, contact means carried by said strip line located adjacent to the other end of said strip line and including a center contact electrically connected to the conductor and extending therefrom and a ground plane contact electrically connected to the ground planes and extending therefrom for engaging said flush coaxial contact, and biasing means operatively engaging the strip line for biasing said center contact and said ground plane contact into contact with said flush coaxial contacts.

2. The connector of claim 1, wherein the biasing means comprises a resilient pad operatively engagable with the strip line.

3. The connector of claim 2, wherein the resilient pad operatively engages the strip line between the ground and center contacts.

4. The connector of claim 3, wherein a cylindrical member is positioned on the opposite side of the strip line from the center contact and the ground contact and the resilient pad engages the cylindrical merber.

5. A connector for mating with flush coaxial contacts comprising, a connector housing, a strip line including opposed ground planes and a conductor running between the ground planes and insulated therefrom, the strip line being of longitudinal configuration with opposed ends and mounted to the housing substantially at one of said ends, contact neans located adjacent to the other end of said strip line and including a center contact electrically connected to the conductor and extending therefrom and a ground plane contact electrically connected to the ground planes and extending therefrom for engaging said flush coaxial contacts, biasing means operatively engaging the strip line for biasing the center and ground plane contacts into contact with the coaxial contacts the biasing means comprising a resilient pad operatively engaging the strip line between the ground and center contacts, a cylindrical member being positioned on the opposite side of the strip line from the center and ground contacts and the resilient pad engaging the cylindrical member, and the cylindrical member being located substantially half way between the center and ground contacts and having an axis which is oriented transversely of a line between said contacts.

6. A connector for mating with flush coaxial contacts comprising, a connector housing, strip line including opposed ground planes and a conductor running between the ground planes and insulated therefrom, the strip line being of longitudinal configuration with opposed ends and mounted to the housing substantially at one of said ends, contact means located adjacent to the other end of said strip line and including a center contact electrically connected to the conductor and extending therefrom and a ground plane contact electrically connected to the ground planes and extending therefrom for engaging said flush coaxial contacts, the ground plane contact including a flexible conductive member attached to the strip line and a ground contact surface projecting therefrom, and the ground contact projecting beyond the center contact for providing first contact with the coaxial contacts, and the flexible conductive member bending to position the ground contact and center contact into substantially the same plane for providing electrical connection to both of the coaxial contacts.

7. The connector of claim 6, wherein the ground contact defines an arcuate surface.

8. The connector of claim 6, wherein the flexible conductive member is riveted to the strip line.

9. The connector of claim 6, wherein a resilient pad engages the strip line adjacent to the flexible conductive member.

* * * * *